United States Patent [19]

Kaneda

[11] 4,306,177

[45] Dec. 15, 1981

[54] DISCHARGE LAMP LIGHTING DEVICE WITH A DELAYED-OUTPUT OSCILLATION CIRCUIT

[75] Inventor: Isao Kaneda, Otsu, Japan

[73] Assignee: New Nippon Electric Co., Ltd., Osaka, Japan

[21] Appl. No.: 132,327

[22] Filed: Mar. 20, 1980

[30] Foreign Application Priority Data

Mar. 22, 1979 [JP] Japan ..... 54-33859
Mar. 27, 1979 [JP] Japan ..... 54-36465

[51] Int. Cl.[3] ..... H05B 41/16
[52] U.S. Cl. ..... 315/244; 315/101; 315/106; 315/289; 315/DIG. 2
[58] Field of Search ..... 315/101, 105, 106, 244, 315/289, DIG. 2

[56] References Cited

U.S. PATENT DOCUMENTS 4,079,292 3/1978 Kaneda ..... 315/289
4,165,475 8/1979 Pegg et al. ..... 315/101

*Primary Examiner*—Eugene R. LaRoche
*Attorney, Agent, or Firm*—W. G. Fasse; D. F. Gould

[57] ABSTRACT

A high frequency and high voltage generating circuit for a discharge lamp lighting device controls its initial output at the starting time of a discharge lamp to prevent applying a high voltage to the discharge lamp in the "cold cathode" state. The circuit comprises in combination an oscillation circuit having an oscillation capacitor, a non-linear inductor and a thyristor, and an initial output limiter for delaying the output supply until the lamp filament is sufficiently preheated for preventing sputtering and for extending the operational life of the discharge lamp. The output control is formed as a bias circuit for the nonlinear inductor and includes a thermistor with a negative or a positive temperature coefficient.

11 Claims, 18 Drawing Figures

FIG. 1 (PRIOR ART)
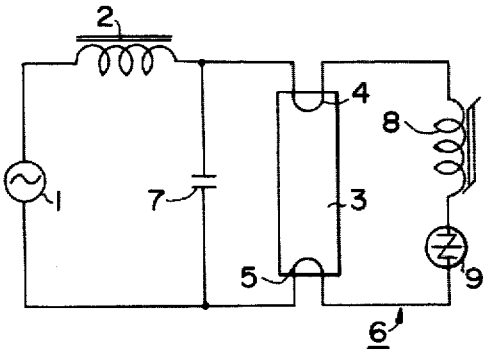
FIG. 2 (PRIOR ART)
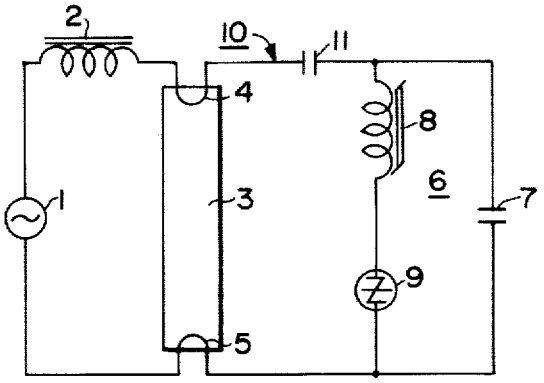
FIG. 4
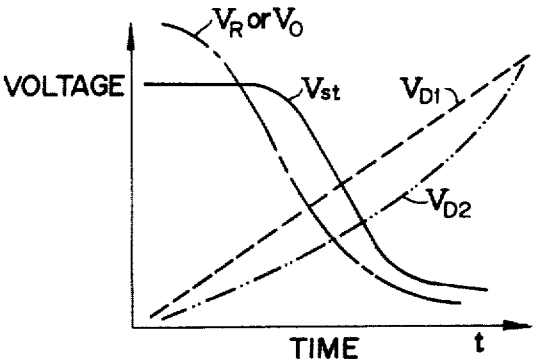
FIG. 5
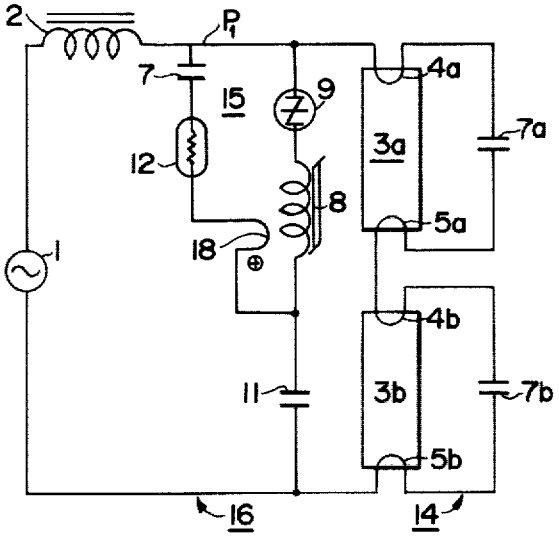
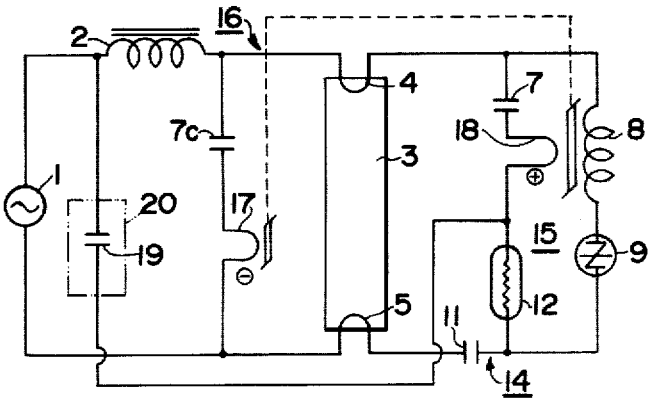
FIG. 6

FIG. 10
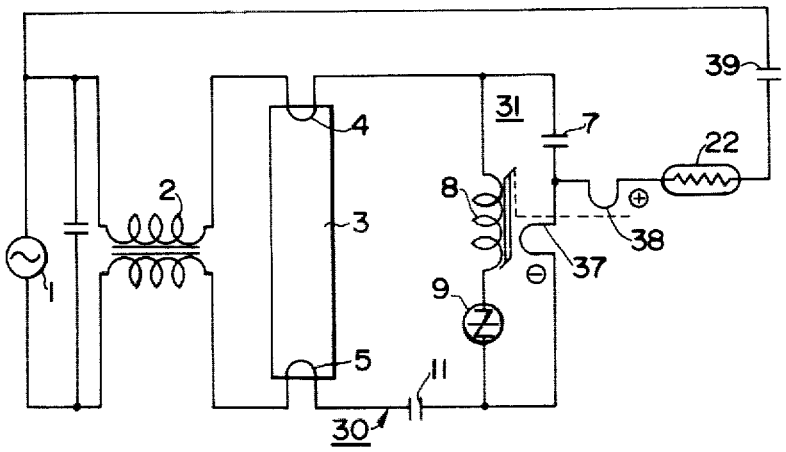
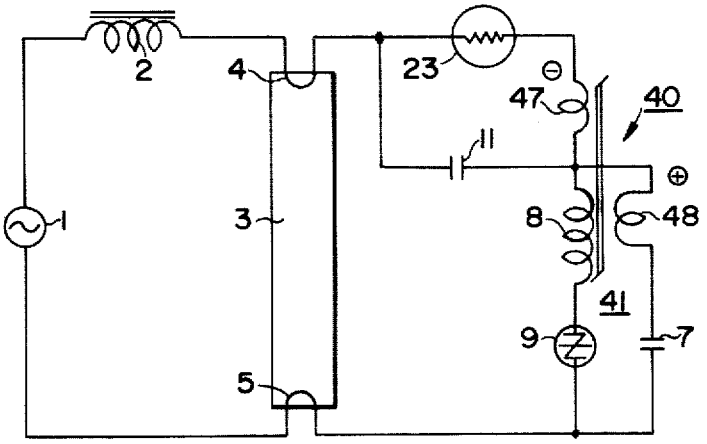
FIG. 11
FIG. 12
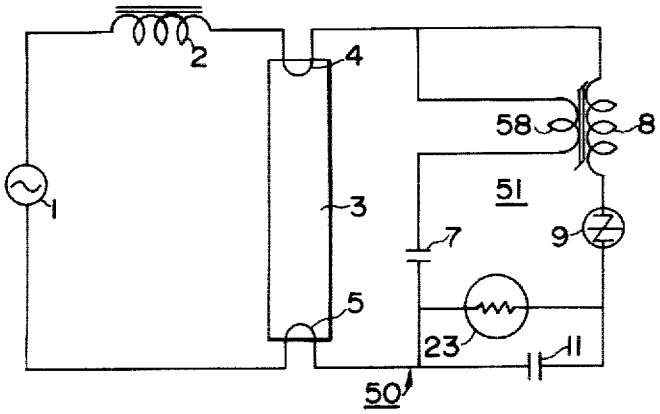

DISCHARGE LAMP LIGHTING DEVICE WITH A DELAYED-OUTPUT OSCILLATION CIRCUIT

BACKGROUND OF THE INVENTION

This invention relates to a discharge lamp lighting device employing a booster circuit for starting and/or reigniting discharge lamp means. More particularly the invention relates to oscillation circuit arrangements used in the lighting device for improving the characteristics of the discharge lamp or lamps.

In recent years various types of discharge lamp lighting devices have been developed for using energy in an optimal manner to save energy resources. In such devices an oscillation circuit or booster is used for starting and/or reigniting a discharge lamp, as disclosed in U.S. Pat. Nos. 3,665,243; 3,753,037; 3,866,088; 3,942,069; and 4,145,638 for the starter, and U.S. Pat. No. 4,079,292; and a copending U.S. Patent Application Ser. No.: 873,241, filed on Jan. 30, 1978, now U.S. Pat. No. 4,238,708, issued Dec. 9, 1980, for a reigniting device. The following explanations shall facilitate the understanding of conventional lighting devices and the function and problems of electronic starting systems and of the so-called "every half cycle ignited system". A conventional lighting device for discharge lamps is first explained by referring to the circuit of FIG. 1, comprising an a.c. power source 1, a current limiting ballast choke 2, a discharge lamp 3 with filaments 4, 5 connected in series with the source 1 through the choke 2, and an oscillation circuit 6 for generating a high frequency and high voltage output. The oscillation circuit 6 connected to the lamp 3, comprises an oscillation capacitor 7 connected between filaments 4 and 5 at the source side, and a series circuit formed by a voltage step-up or nonlinear inductor 8 and a thyristor 9, which is connected between filaments 4 and 5 at the side opposite the source. In the operation, the oscillation capacitor 7 is charged by supplying an a.c. power from the source 1. The thyristor 9 becomes conductive when the terminal voltage of the capacitor 7 exceeds the break-over voltage of the thyristor 9. Thus, a high frequency oscillating voltage is generated by the cooperation of the capacitor 7 and the inductor 8. This output voltage Vo is higher than the source voltage "e" and is applied to the lamp 3. While the low frequency current of the a.c. power source 1 flowing through the thyristor 9 gradually increases, until the current exceeds a holding current thereof, the thyristor 9 maintains its continuous conductive state so as to stop the oscillation. Then, due to the repetition of the above operations in each half cycle, the oscillation circuit 6 repeats the high frequency oscillation. Meanwhile, the filaments 4, 5 of the lamp 3 are preheated by the overlapped current of the oscillating current during the oscillation period of the oscillation circuit 6, and the input current flows in a closed circuit of elements 1-2-4-8-9-5-1, when the thyristor 9 is in the conductive state. Thus, as the high frequency oscillation continues to preheat the filaments 4, 5 to a sufficiently preheated state, the discharge lamp 3 starts its initial ignition by the output voltage Vo of the oscillation circuit 4. When the lamp 3 is operated at the initial ignition, the thyristor 9 becomes nonconductive and the operation of the oscillation circuit 6 ceases.

FIG. 2 illustrates a more recent conventional lighting device for discharge lamps, wherein an intermittent oscillation circuit 10 is used to operate a discharge lamp 3 for its initial ignition during a starting period and its reignition at each half cycle of the a.c. power source 1 in the normal lighting operation. This circuit is very efficient in its use of energy and has achieved a ballast choke of minimal size and weight, thereby also saving energy.

Although similar to the circuit of FIG. 1, the lighting device of FIG. 2 comprises the a.c. power source 1, a ballast choke 2, a discharge lamp 3, the oscillation circuit 6 and further a second capacitor 11 for an intermittent oscillation in series connection with the oscillation circuit 6 for generating a high frequency and high voltage oscillation. That is, the intermittent oscillation circuit 10 comprises a series circuit of the second capacitor 11 for an intermittent oscillation and the oscillation circuit 6 including the oscillation capacitor 7, nonlinear inductor 8 and thyristor 9. As far as the generation of a high frequency and high voltage output is concerned, the intermittent oscillation circuit may be replaced by another type of booster circuit using a gated thyristor such as a triac or an inverter.

FIG. 3 shows a set of operational voltage wave forms for the lighting device of FIG. 2, which may be calculated with the aid of an equivalent circuit of FIG. 2, but high frequency components are omitted from each of the wave forms of FIG. 3, excepting FIG. 3(D). By switching on the power source, the source voltage "e" in FIG. 3(A) is supplied to the lamp 3 through the choke 2 and the intermittent oscillation circuit 10, and also to the thyristor 9 through the second capacitor 11. The thyristor 9 becomes conductive when the source voltage "e" rises to the break-over voltage thereof, and the oscillation circuit 6 generates an output in cooperation of the first oscillation capacitor 7 and the inductor 8. The oscillating operation will be continued if the second intermittent oscillation capacitor 11 is not inserted, but due to the oscillating action of the oscillation circuit 6 the second intermittent oscillation capacitor 11 is gradually charged until the terminal voltage of the first capacitor 7 cancels the source voltage "e" and the oscillation circuit 6 starts to oscillate intermittently at an initial time period of each half cycle of the source voltage "e". Accordingly, the intermittently oscillating circuit 11 generates an intermittent oscillation output $V_R$ at a fixed phase of each half cycle of the a.c. source voltage "e".

The intermittent oscillating output $V_R$ is supplied to the discharge lamp 3 together with the source voltage "e" as shown in FIG. 3(D). At the same time, an input current $i_R$ in the circuit 6 flows through a circuit path of the power source 1, ballast choke 2, filament 4, intermittent oscillation circuit 10, filament 5, and back to the power source 1. Accordingly, the filaments 4, 5 of the discharge lamp 3 are preheated by the current $i_R$. Thus, preheated filaments 4, 5 lower the initial starting voltage of the discharge lamp 3 which is lit by the sum of the source voltage "e" and the oscillating output $V_R$. After the lamp 3 is lit, the lamp current $i_T$ of the discharge lamp 3 flows through the ballast choke 2 as shown in FIG. 3(C). Also, since the choke impedance is changed, the occurring period of the input current $i_R$ becomes shorter than that of the preheating stage. Actually, during the suspended or ceased time of the input current $i_R$, the oscillation circuit 6 stops its oscillation, and accordingly the preheating of the filament by the input current $i_R$ decreases while the lamp 3 sustains its lit condition at each half cycle. Also, during the suspended time of the input current $i_R$, preheating of the filaments 4, 5 ceases. After the initial lighting of the lamp 3 is started, the lamp maintains its burning state by reignition due to the oscillation output $V_R$ of the intermittent oscillation circuit 10 at each half cycle of the power source 1.

Here, a lamp voltage $V_T$ shows a rectangular wave form with a portion corresponding to the suspended time in the intermittent oscillating period as shown in FIG. 3(B), and its effective value $V_T$ shows a rather lower value compared with that of conventional lighting systems. Further, as shown in FIG. 3(E), due to the flow of the intermittent input current $i_R$ through the ballast choke 2, the wave form of the lamp voltage $V_T$ somewhat rises under the influence of the input current $i_R$. An appearing phase of the input current $i_R$ is almost constant regardless of any variation of fluctuation of the source voltage, and accordingly the initial phase of the lamp current $i_T$ is maintained to be an almost constant phase regardless of any fluctuation of the source voltage "e". Also, the input current $i_R$ has a negative coefficient characteristic to decrease if the lamp current $i_T$ increases as the source voltage rises due to an encroachment of a remaining portion of the wave of the lamp current $i_T$ upon the occurring period of the next half cycle input current $i_R$. For this reason the fluctuation rate of the lamp current $i_T$ in the "each half cycle ignited lighting system" is preferably maintained regardless of any reduction of a stabilizing impedance.

FIGS. 3(F) and 3(G) show wave forms of the instantaneous reactive power ($V_{CH}$.i) and accumulated energy S of the ballast choke 2 which are calculated from the lamp voltage $V_T$, lamp current $i_T$, input current $i_R$ of the intermittent oscillation circuit 10, oscillating output voltage $V_R$, and source voltage "e". Namely, in FIG. 3(F), S1 is the energy accumulated by the input current $i_R$ in the oscillating period between t1 and t2, S2 is the energy accumulated by the lamp current $i_T$ in the period between t2 and t3 during which the source voltage "e" exceeds the lamp voltage $V_T$, S3 is the energy released by the lamp current $i_T$ in the period between $t_3$ and $t_4$ during which the lamp voltage $V_T$ exceeds the source voltage "e", and the expression S1+S2=S3 applies.

The accumulated energy and the necessary inductance of the ballast choke 2 are calculated from the wave forms as shown in FIG. 2 and indicate respectively to be about a quarter and a fifth compared with those of conventional glow start systems, accordingly the "each half cycle ignited system" is capable of minimizing the ballast choke 2 in accordance with the above ratio.

Further, in comparison with a ballast of the rapid start system providing a step-up transformer, the minimizing ratio becomes even more remarkable. Moreover, according to said lighting system, the phase difference between the source voltage "e" and the lamp current $i_T$ is smaller than that of the conventional lighting systems, therefore, it is possible to omit a power-factor improving capacitor or to use a capacitor having an extremely small capacity.

As described above, the "every half cycle lighting system" has a remarkable advantage of saving resources and energy in comparison with the conventional lighting systems, it also has an excellent fluctuation of the lamp current, and permits the miniaturization of the ballast in comparison with that of the conventional lighting systems. FIG. 4 is a characteristic diagram showing the necessary starting voltage Vst and oscillating voltage Vo or $V_R$ as a function of time t during the starting period, when the discharge lamp 3 is operated by the conventional lighting devices shown in FIGS. 1 and 2 respectively. Referring to FIG. 4 when the filaments of the discharge lamp 3 are in the "cold cathode" state, the filaments 4, 5 are not sufficiently preheated and a comparatively high initial ignition voltage or starting voltage Vst is required to initiate the operation of the discharge lamp 3. However, when the filaments 4, 5 are sufficiently preheated, namely, when they are in the "hot cathode" state, the lamp 3 starts its ignition even with a comparatively low starting voltage. Further, each of the filaments 4, 5 has a characteristic such that the resistance value is low at the "cold cathode" state, but it becomes high at the "hot cathode" state. Also, if filaments are included in the oscillation circuit 6 as shown in FIG. 1, the oscillating output voltage is lowered by the resistance components of the "hot cathode" state filament. Therefore, it is necessary to select a capacitance value for the oscillation capacitor and an inductance value for the inductor to provide a counterbalanced oscillating output voltage. However, if these values in the circuits of FIGS. 1 and 2 are selected accordingly, an extremely high oscillating output voltage Vo or $V_R$ is caused when the filaments 4, 5 are in a "cold cathode" state, and if such high oscillating voltage Vo or $V_R$ above the starting voltage Vst is supplied to both filaments in a "cold cathode" state, defects caused by sputtering due to a cold cathode glow discharge and a short life of the discharge lamp 3 will occur. Accordingly, as shown by dotted lines $V_{D1}$ or $V_{D2}$, it is desired ideally to provide a characteristic curve for the output voltage, so that the oscillating voltage $V_{D1}$ or $V_{D2}$ is restricted for a given period of initial time after the power source voltage is supplied. In other words, after the filaments 4, 5 are sufficiently preheated it is desired that the oscillating voltage rises to start the discharge lamp 3 in its lighting operation.

OBJECTS OF THE INVENTION

In view of the foregoing, it is the aim of the invention to achieve the following objects singly or in combination:

- to provide a discharge lamp lighting device employing an oscillation circuit wherein the output of the oscillation circuit during an initial operating time is restricted so as to improve the lamp characteristics;
- to provide a discharge lamp lighting device for an electronic starting system or for an "every half cycle ignited operating system", wherein high frequency and high voltage generating means are used for causing the initial ignition of a discharge lamp, wherein a delayed-output voltage is supplied to the discharge lamp at the starting time thereof for preventing sputtering and attaining a long life of the discharge lamp;
- to provide a low-cost and simplified lighting device for a discharge lamp having filaments to be preheated at the starting period, wherein a delaying operation system of an oscillation circuit for the initial ignition of the discharge lamp, is effective during the starting period;
- to provide a discharge lamp lighting device employing two oscillation circuits at least one of which is provided with initial output control means so as to suppress the output voltage applied to the discharge lamp at the starting time; and
- to provide a lighting device for discharge lamp means wherein high frequency and high voltage output generating means for the initial ignition and/or reignition of the discharge lamp means comprises at least an oscillation circuit having an oscillation capacitor, a nonlinear inductor, a thyristor and initial output controlling means, such as biasing means, for the nonlinear inductor and/or thermistor means, and wherein the output voltage of the oscillation circuit is restricted during the initial time of a "cold cathode" state so as to prevent sputtering to thereby extend the effective life of the discharge lamp or lamps.

SUMMARY OF THE INVENTION

In accordance with the invention there is provided a discharge lamp lighting device employing high voltage generating means for the initial ignition and/or reignition of a discharge lamp wherein the output voltage is supplied with a certain delay to the discharge lamp to restrict the initial starting voltage in order to improve the operating characteristics of the discharge lamp. According to one aspect of the present invention, the high frequency and high voltage generating means for the initial ignition of a discharge lamp or lamps in the lighting device comprises a first oscillation circuit including preheating means for the discharge lamp and a second oscillation circuit formed without preheating means for the discharge lamp, wherein the output of the second oscillation circuit is restricted in its operation at the initial starting time by delaying means, whereby the operating life and the appearance characteristics of the discharge lamp are improved. In other words, the second oscillation circuit formed without filaments of the discharge lamp includes a negative characteristic thermistor to restrict the oscillating operation of the second oscillation circuit by the function of the thermistor during the time of a cold cathode state of the discharge lamp. Meanwhile the filaments are preheated by the first oscillation circuit, until they are sufficiently preheated into a "hot cathode" state under the restricted condition of the output of the second oscillation circuit. When the filaments are in the hot cathode state, the restriction of the second oscillation circuit is terminated to elevate the output by decreasing the resistance of the thermistor so as to assure the initial ignition of the lamp.

According to another aspect of the invention, the high frequency and high voltage generating means comprise a nonlinear inductor and bias means to vary the magnetic flux density amplitude, or to change the magnetic flux density, of the nonlinear inductor for an oscillating output voltage control. The bias means restrict the output voltage initially to a value below that necessary for the starting voltage of the discharge lamp, the filaments of which are in a "cold cathode" state due to an insufficient preheating, and to rise or elevate the output voltage above the starting voltage of the discharge lamp, after the lamp filaments are sufficiently preheated to be in a "hot cathode" state.

BRIEF FIGURE DESCRIPTION

In order that the invention may be clearly understood, it will now be described, by way of example, with reference to the accompanying drawings, wherein:

FIG. 1 is a circuit of a conventional discharge lamp lighting device comprising an electronic starting system;

FIG. 2 is a circuit of another conventional discharge lamp lighting device of the "each half cycle ignited system" type;

Figure 3A:
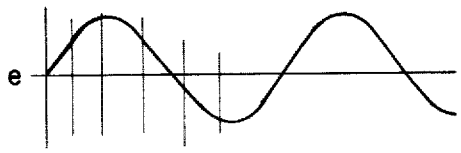
Figure 3B:
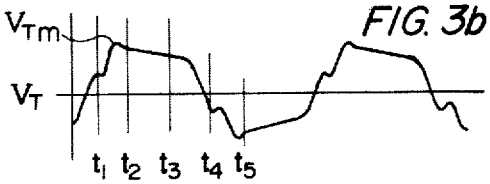
Figure 3C:
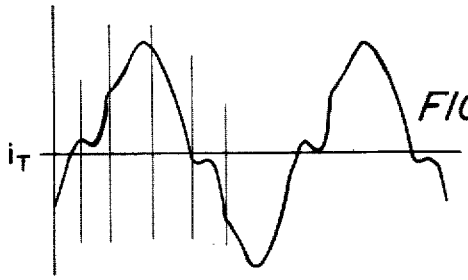
Figure 3D:
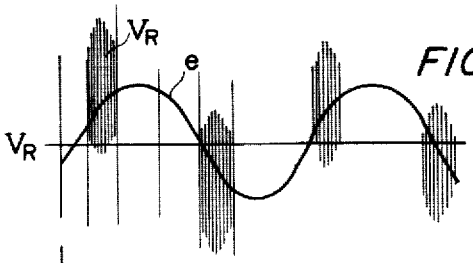
Figure 3E:
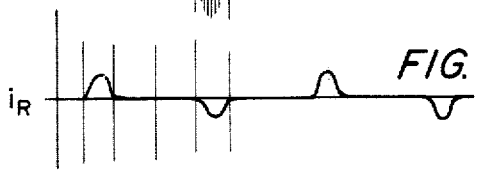
Figure 3F:
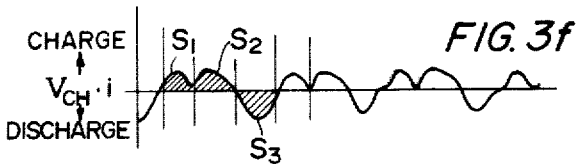
Figure 3G:
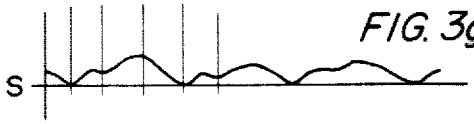
Figure 7:
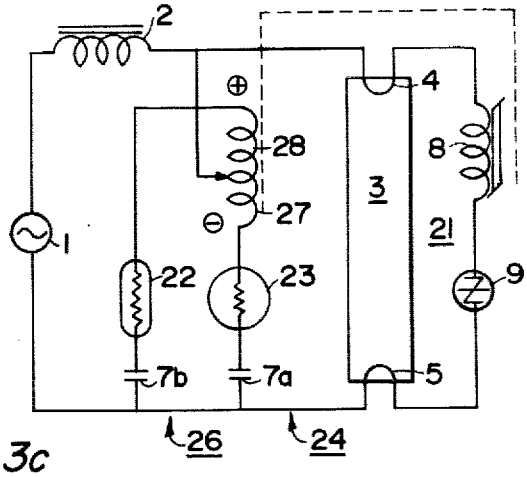
Figure 8:
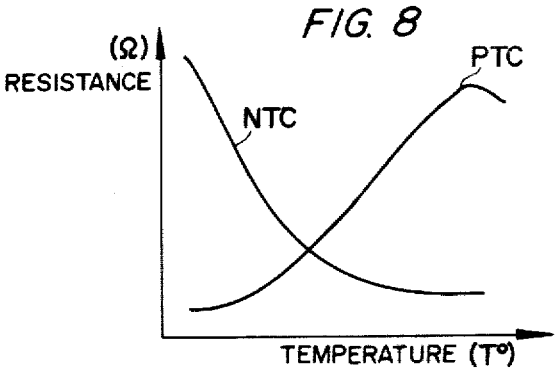
Figure 9:
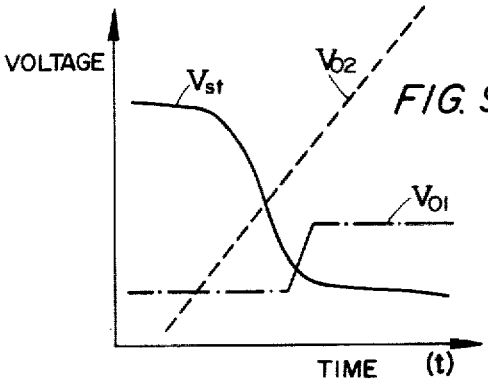

FIGS. 3*a*–3*g* are a set of operation explanatory diagrams of the circuit of FIG. 2;

FIG. 4 is a characteristic diagram showing the relation of voltages Vst, Vo and $V_R$ as a function of time t for explaining the initial starting period of the circuits of FIGS. 1 and 2;

FIG. 5 is a circuit of a discharge lamp lighting device of an embodiment according to the present invention;

FIG. 6 is a circuit of another embodiment with a reverse charge circuit according to the present invention;

FIG. 7 is a circuit of a further embodiment according to the present invention;

FIG. 8 is a graph showing the relation of the resistance as a temperature function of the thermistors used in the circuit of FIG. 7;

FIG. 9 is a characteristic diagram showing the relation of voltages Vst, Vo as a function of time t in connection with the circuit of FIG. 7;

FIG. 10 is a circuit of still another embodiment according to the present invention;

FIG. 11 is a circuit of a still further embodiment according to the present invention; and FIG. 12 is a modification of the circuit of FIG. 11.

DETAILED DESCRIPTION OF PREFERRED EXAMPLE EMBODIMENTS AND OF THE BEST MODE OF THE INVENTION

FIG. 5 is an electric circuit of a discharge lamp lighting device of the "every half cycle ignited system" type for an embodiment of the invention in which two series connected lamps are operated by the intermittent oscillation circuit as a means for generating a high frequency and a high voltage. An a.c. source 1 is connected to two discharge lamps 3*a*, 3*b* in series through a ballast choke 2. A series connected intermittent oscillating circuit of a thyristor 9, a nonlinear inductor 8, and a capacitor 11, is connected in parallel with the filaments 4*a*, 5*b* of the series connected discharge lamps 3*a*, 3*b*. A series connected circuit comprising an oscillation capacitor 7, a thermistor 12 having a negative temperature coefficient characteristic and a positive bias coil 18, is connected in parallel with the series circuit of the thyristor 9 and inductor 8. The coil 18 has a biasing action on the inductor 8 to increase the inductance thereof and is magnetically coupled with the inductor 8. Besides, an oscillation capacitor 7*a* is connected in parallel with the filaments 4*a*, 5*a* of the discharge lamp 3*a* at the side opposite the source. An oscillation capacitor 7*b* is connected in parallel with the filaments 4*b*, 5*b* of the discharge lamp 3*b* at the side opposite the source. Accordingly, a first intermittent oscillation circuit 14 is formed by the closed circuit of the thyristor 9, the inductor 8, the capacitor 11 for causing an intermittent oscillation and oscillation capacitors 7*a*, 7*b*. The filaments 4*a*, 5*a*, 4*b*, 5*b*, are connected in this circuit. Additionally, an oscillation circuit 15 is formed by the closed circuit of the oscillation capacitor 7, the thyristor 9, the inductor 8, plus the bias coil 18 and the thermistor 12. Also, a second intermittent oscillation circuit 16 without the filaments is formed by a circuit in which the intermittent oscillation capacitor 11 is connected in series with the oscillating circuit 15.

In operation, when the power source 1 is switched on, the current flows in the path comprising the filament 4a, the oscillation capacitor 7a, the filament 5a, the filament 4b, the oscillation capacitor 7b, the filament 5b, and the ballast choke 2, whereby the oscillation capacitors 7a, 7b are charged. When the terminal voltage of the series circuit of the capacitors 7a, 7b exceeds the break-over voltage of the thyristor 9, the thyristor 9 becomes conductive, the first intermittent oscillation circuit 14 starts its oscillating action, and the filaments 4a, 5a, 4b, 5b are preheated by the oscillating current. Because the oscillating voltage of the first intermittent oscillation circuit 14 is divided by each of the oscillation capacitors 7a, 7b, the supply voltage to each discharge lamp 3a, 3b is comparatively low, and the lamps do not start their lit condition yet. That is, immediately after the power source is switched on, the temperature (by the self-heating and heat-up of surrounding parts) of the thermistor 12 has not yet risen and the resistance value of the thermistor 12 is comparatively high. Accordingly the oscillation circuit 15 including the thermistor 12 is not yet able to oscillate. At this time, the intermittent oscillation circuit 14 generates an oscillation at each half cycle of the source voltage by the action of the intermittent oscillation capacitor 11. However, this is different from the conventional circuit of FIG. 2, since the circuit 14 does not always generate an intermittent oscillation during the preheating time, and accordingly, the filaments 4a, 5a, 4b, 5b can be preheated by the large current of the high frequency oscillation.

As each filament of the discharge lamps 3a, 3b is sufficiently preheated to assume the "hot cathode" state, the thermistor 12 is gradually heated up by the oscillating current of the second intermittent oscillation circuit 16, and the resistance of the thermistor 12 becomes very low in comparison with that at the time immediately after the power source is switched on. In accordance with such state, the restricted oscillating voltage of the oscillation circuit 15 rises as the resistance of the thermistor 12 decreases, together with biasing action of the positive bias coil 18, whereby the oscillating voltage of the second circuit rises higher than the oscillating voltage of the first intermittent oscillation circuit 14 and this higher oscillating voltage is supplied to both ends of each discharge lamp 3a, 3b, whereby the lamps start their initial lighting by the higher oscillating voltage. Once the discharge lamps have started their initial lit state, such state of the discharge lamps 3a, 3b is maintained by the reignition at each half cycle of the source voltage "e".

Thus, because the oscillating voltage which is supplied to both ends of the discharge lamps 3a, 3b for starting their initial ignition, is restricted at the time of the "cold cathode" state of the discharge lamps 3a, 3b and the oscillating voltage rises after the discharge lamps are brought to a "hot cathode" state, such device has the advantages that supplying a high voltage to the discharge lamps 3a, 3b in the "cold cathode" state is avoided, accordingly sputtering due to a glow discharge in the "cold cathode" state is prevented, and a long life of the discharge lamp is attained.

In the above embodiment, the thermistor 12 is inserted in the closed oscillation circuit 15 and outside of the lamp current path. However, the inserting position is not limited to such arrangement. The thermistor may be inserted in the path of lamp current within the oscillation circuit 15, for example at the point P1. Besides, for certain lamp types the positive bias coil 18 may be omitted.

FIG. 6 is a circuit diagram showing a discharge lamp lighting device of another embodiment of the invention. A single discharge lamp 3 is connected in series with an a.c. power source 1 through a ballast choke 2, a second intermittent oscillation circuit 16, including an oscillation circuit 15 and a capacitor 11 for intermittent oscillation connected in series excluding the filaments, is connected with the terminals of the lamp filaments 4, 5 on the side opposite the source. The oscillation circuit 15 is formed by connecting in parallel a series circuit of the thyristor 9 and the inductor 8 and a series circuit of the oscillation capacitor 7, a positive bias coil 18 magnetically coupled with the inductor 8 and a thermistor 12. Besides, a series connected circuit of the oscillation capacitor 7c and a negative bias coil 17 magnetically coupled with the inductor 8, is connected in parallel with the source side of the lamp filaments 4, 5. The first intermittent oscillation circuit 14 including the filaments is formed by a closed circuit including the oscillation capacitor 7c, the filament 4, the inductor 8, the thyristor 9, the intermittent oscillation capacitor 11, the filament 5, and the negative bias coil 17. The first and second intermittent oscillation circuits act as high frequency and high voltage generating means.

Further, a reverse charge circuit 20 is connected between the power source 1 and a junction of the positive bias coil 18 and the thermistor 12 to remove a disadvantageous effect which may be caused by a change in the source voltage. The reverse charge circuit 20 acts to compensate a possible change of terminal voltage of the intermittent oscillation capacitor 11 due to the source voltage change. For instance, a capacitor 19 is used for such compensation.

In operation, when the a.c. power source is switched on, the electric current flows in the path through the ballast choke 2, the oscillation capacitor 7c and the negative bias coil 17, whereby the oscillation capacitor 7c is charged. Immediately after the source voltages is switched on, the oscillation capacitor 7 is only charged with an extremely small current due to the high resistance of the thermistor 12. When the terminal voltage of the oscillation capacitor 7c has risen above the break-over voltage of the thyristor 9, the first intermittent oscillation circuit 14, including the filament 5, starts the high frequency oscillating action. However, at this time, because the charging current of the capacitor 7c flows through the negative bias coil 17, the latter restricts the inductance of the inductor 8. Accordingly, immediately after the source supply when the discharge lamp 3 is in the "cold cathode" state, only the first intermittent oscillation circuit 14 oscillates, whereby the filaments 4, 5 are preheated by the increased oscillating current due to the action of the negative bias coil 17. Meanwhile, only a comparatively low oscillating voltage is supplied to both ends of the discharge lamp 3. Thus, the filaments 4, 5 are preheated by the intermittent oscillation of the first intermittent oscillation circuit 14 and the oscillation capacitor 7 begins to be charged effectively as the resistance of the thermistor 12 decreases due to its gradually rising temperature. Because the resistance of the thermistor 12 becomes a minimum when the filaments of the discharge lamp 3 are preheated into the "hot cathode" state, the capacitor 7 is sufficiently charged, and the oscillation circuit 15 starts to generate its proper high frequency oscillation. The oscillating action of the oscillation circuit 15 becomes an intermittent oscillation at each cycle due to the intermittent oscillation capacitor 11. Besides, the oscillating voltage of the oscillation circuit 15 rises due to an increased inductance of the inductor 8 because the charging current of the capacitor 7 in the oscillation circuit 15 flows through the positive bias coil 18. Accordingly the risen oscillating voltage of the second intermittent oscillation circuit 16 extending the oscillating voltage of the first intermittent oscillation circuit 14, is supplied to both ends of the discharge lamp 3, namely, as the discharge lamp 3 attains the "hot cathode" state, the oscillating voltage rises and the discharge lamp 3 starts its initial ignition by the risen oscillating voltage. Once the discharge lamp 3 has started, the operation of the lamp 3 is maintained by the reignition at each half cycle by the intermittently oscillating voltage of the oscillation circuits 14, 16.

Further, after the initial ignition of the discharge lamp is started, if the voltage of the power source 1 rises, the reverse charging voltage supplied through the reverse charge circuit 20 and the thermistor 12 to one side of the oscillation circuit 15 rises and the intermittent oscillation capacitor 11 is reversely charged more rapidly. Accordingly, the capacitor 11 limits the intermittent oscillation period of the intermittent oscillation circuits 14, 16, whereby the lamp current is decreased and the power source regulation is thus improved.

Further, the effect of the reverse charge circuit 20 becomes more pronounced when the electrostatic capacitance of the capacitor 19 which is used as a principal element, is increased. However, at the initial lighting time it may happen that the thyristor 9 does not break-over due to a decrease in its terminal voltage. Such failure may be avoided by inserting the thermistor 12 to limit the current of the reverse charge circuit 20 at the starting time whereby the power source regulation can be sufficiently improved.

In this embodiment the sputtering of the discharge lamp 3 is also prevented and a long life of the discharge lamp is advantageously attained. Further, because this embodiment is provided with the reverse charge circuit 20, there is another advantage in that the power source regulation is improved.

The present invention is not limited to the so-called "every half cycle ignited system". The present invention is also applicable to other types of discharge lamp lighting devices which maintain the lit condition by the power source voltage only, by a circuit omitting the capacitor 11 for intermittent oscillation, generating a high frequency and a high voltage to supply the discharge lamp, at the same time preheating the lamp filaments at the starting time of the initial ignition, and wherein, after the lamp has started, the high frequency and high voltage generating means stop their oscillating operation.

FIG. 7 shows still another embodiment of the present invention, and FIG. 8 shows a characteristic diagram of a positive temperature coefficient thermistor (PTC) and a negative temperature coefficient thermistor (NTC) as temperature sensitive elements for controlling bias means for the "cold or hot cathode" state of the discharge lamp.

FIG. 7 shows a "hot cathode" type discharge lamp 3 connected in series with a power source 1 through a ballast choke 2. An oscillation circuit 21 operates as high frequency and high voltage generating means and is connected in parallel with the discharge lamp 3.

The oscillation circuit 21 is formed by a series circuit of a thyristor 9 and a nonlinear inductor 8 connected in parallel with the terminals of the lamp filaments 4, 5 on the side opposite the source. The circuit 21 further includes a parallel connected circuit comprising a series circuit of a negative bias coil 27 coupled with the inductor 8, a thermistor 23 with a positive temperature coefficient and an oscillation capacitor *7a*, and a series circuit including a positive bias coil 28 coupled with the inductor 8, a thermistor 22 with a negative temperature coefficient and an oscillation capacitor *7b*, connected in parallel with the source side terminals of the filaments 4, 5 of the discharge lamp 3.

In operation, at the time immediately after the power source is switched on, the discharge lamp 3 is still in a "cold cathode" state, because the thermistor 23 with its positive temperature coefficient provides a low resistance and the thermistor 22 with its negative temperature coefficient provides a high resistance. Therefore, the first oscillation circuit 24 formed by the closed circuit of the oscillation capacitor *7a*, the thermistor 23 with a positive temperature coefficient, the negative bias coil 27, the filament 4, the inductor 8, the thyristor 9, the filament 5 and the oscillation capacitor *7a*, oscillates. At the time when the discharge lamp 3 is in a "hot cathode" state the second oscillator circuit 26 oscillates because the thermistor 23 with its positive temperature coefficient provides a high resistance and the thermistor 22 with its negative temperature coefficient provides a low resistance. The second oscillation circuit 26 is formed by the closed circuit of the oscillation capacitor *7b*, the thermistor 22, the positive bias coil 28, the filament 4, the inductor 8, the thyristor 9, the filament 5, and the oscillation capacitor *7b*.

FIG. 9 is a characteristic diagram showing the relation of the oscillating voltage Vo as a function of time t to explain the action of the circuit of the invention. The operation will now be described with reference to FIGS. 7 to 9.

Immediately after the power source 1 is switched on, both thermistors 22 and 23 are at room temperature. Accordingly, the resistance of the thermistor 23 is small and the resistance of the thermistor 22 is very large due to said different temperature coefficients. Hence, the current from the a.c. power source 1 flows through a path of the ballast choke 2, the negative bias coil 27, the thermistor 23, the oscillation capacitor *7a* and back to the a.c. source 1, whereby the oscillation capacitor *7a* is charged. When the terminal voltage of the oscillation capacitor *7a* exceeds the break-over voltage of the thyristor 9, the thyristor 9 becomes conductive, accordingly, the first oscillation circuit formed by the closed circuit of the oscillation capacitor *7a*, the thermistor 23, the negative bias coil 27, the filament 4, the inductor 8, the thyristor 9, the filament 5, and the oscillation capacitor *7a*, starts a high frequency oscillation and generates the oscillating voltage Vo1. At this time, because the negative bias coil 27 reduces the magnetic flux density amplitude, by its negative biasing action on the inductor 8, the oscillating output voltage Vo1 becomes low and does not exceed the necessary starting voltage Vst of the discharge lamp 3. Stated differently, the oscillating output voltage is restricted to a comparatively low voltage as shown in FIG. 9 by a broken line Vo1. During the period when the high frequency oscillating current and the low frequency input current overlap, the filaments 4, 5 are preheated. Furthermore, the action of the negative bias coil 27 increases the high frequency oscillating current and the filaments are rapidly preheated. Thus, the filaments 4, 5 gradually assume the "hot cathode" state from a "cold cathode" state as time elapses and the resistance of the filaments is gradually increased by the preheating current.

As described above, after a given period of time has elapsed from the time of switching on the power source supply, the discharge lamp 3 changes to a "hot cathode" state from a "cold cathode" state, and the resistance of the thermistor 23 with its positive temperature coefficient is increased by its self-heating. At the same time the resistance of the thermistor 22 with its negative temperature coefficient is gradually decreased by its self-heating. When the resistance of the thermistor 22 becomes lower than that of the thermistor 23, the current from the a.c. power source 1 flows through a path of the ballast choke 2, the positive bias coil 28, the thermistor 22, and the oscillation capacitor *7b*, whereby the latter is charged. When the terminal voltage of the oscillation capacitor *7b* exceeds the break-over voltage of the thyristor 9, the second oscillation circuit formed by the closed circuit of the oscillation capacitor *7b*, the thermistor 22, the positive bias coil 28, the filament 4, the inductor 8, the thyristor 9, the filament 5, and the oscillation capacitor *7b* starts the oscillation for generating a high frequency output voltage. At this time, the first oscillation circuit gradually lowers its oscillating voltage as the thermistor 23 with the positive temperature coefficient increases the resistance until finally the oscillation circuit stops oscillating. Accordingly, the positive bias coil 28 included in the second oscillation circuit increases the magnetic flux density amplitude of the inductor 8, and the oscillating voltage Vo2 of the second oscillation circuit rises above the necessary starting voltage Vst of the discharge lamp 3. Thus, an oscillating voltage Vo2 larger than the necessary starting voltage is supplied to both ends of the discharge lamp 3. Accordingly, at the time when the filaments 4, 5 are sufficiently preheated, the discharge lamp 3 starts the initial lit condition when Vo2>Vst. Thereafter the lit condition of the lamp is maintained by the a.c. power source. After the discharge lamp 3 has once started its lit condition, the terminal voltage of the oscillation capacitor *7b* is reduced to below the break-over voltage of the thyristor 9, and the high frequency oscillation of the second oscillation circuit also ceases.

The foregoing features of the invention make certain that initially the supply of a comparatively high oscillation voltage to the discharge lamp is prevented for a time period sufficient for filament preheating. Thus, sputtering of the lamp is also prevented whereby the operational life of the discharge lamp is advantageously increased.

In the above embodiment the magnetic flux density amplitude of the inductor 8 was decreased by the action of the negative bias coil 27 when the discharge lamp is in a "cold cathode" state, and the magnetic flux density amplitude of the inductor 8 was increased by the action of the positive bias coil 28 when the discharge lamp is in a "hot cathode" state. However, other means may be used to achieve a voltage Vo2 as shown by the dotted line of Vo2 in FIG. 9. If the magnetic flux density amplitude of the inductor 8 is selected so that the oscillating voltage generated by the oscillation circuit 21 is lower than the necessary starting voltage of the discharge lamp 3 under an initially zero bias condition, an oscillation control circuit may be obtained by using only the positive bias coil 28 which is magnetically coupled with the inductor 8. The series circuit of the positive bias coil 28, the thermistor 22 with its negative temperature coefficient, and the oscillation capacitor *7b* is connected in parallel with source side terminals of the discharge lamp 3 thereby omitting from the series circuit the negative bias coil 27. On the other hand, if the magnetic flux density amplitude of the inductor 8 is selected so that the oscillation circuit generates an oscillating voltage larger than the necessary starting voltage of the discharge lamp 3 when the bias is initially zero, an oscillation control circuit may be obtained so that only the negative bias coil 27 is magnetically coupled with the inductor 8, and the series circuit of the negative bias coil 27, the thermistor 23 with its positive temperature coefficient and oscillation capacitor *7a* is connected in parallel with the source side terminals of the discharge lamp 3. Further, the oscillation capacitors *7a*, *7b* may be realized by a single oscillation capacitor provided in common for both circuits.

FIG. 10 is a circuit diagram of a discharge lamp lighting device based on the so-called "each half cycle ignited lighting system" as a further embodiment of the present invention, wherein a discharge lamp 3 is connected in series with an a.c. power source 1 through a ballast choke 2 of the divided type. An intermittent oscillation circuit 30 operates as a high frequency and high voltage oscillating means and is connected in parallel with the terminals of the filaments 4, 5 of the discharge lamp 3 on the side opposite the source 1. The intermittent oscillation circuit 30 comprises an oscillation circuit 31 which is formed by a parallel connected circuit of a series circuit including the thyristor 9 and a nonlinear inductor 8, and a series circuit of an oscillation capacitor 7 and a negative bias coil 37 coupled magnetically with the inductor 8, and an intermittent oscillation capacitor 11 which is connected in series with the oscillation circuit 31. A series circuit of a positive bias coil 38 which is magnetically coupled with the inductor 8 for positively biasing the inductor 8, a thermistor 22 with a negative temperature coefficient and a reverse charge capacitor 39, is connected between the junction of the oscillation capacitor 7 and the negative bias coil 37 and the junction of the power source 1 and ballast choke 2. The divided type choke 2 is useful to decrease line noise, and an addition of a capacitor across the source 1 is preferred for noise prevention.

In operation after the a.c. power source 1 is switched on in FIG. 10, the oscillation capacitor 7 is charged through the ballast choke 2, the intermittent oscillation capacitor 11, and the negative bias coil 37. When the terminal voltage of the oscillation capacitor 7 exceeds the break-over voltage of the thyristor 9, the thyristor 9 becomes conductive and a high frequency oscillation is generated in the closed circuit of the oscillation capacitor 7, the inductor 8, the thyristor 9, and the negative bias coil 37.

At this time, the negative bias coil 37 restricts the magnetic flux density amplitude of the inductor 8, whereby the high frequency oscillating voltage is restricted to a comparatively low voltage. Then the high frequency oscillating action is repeated in the same manner and the filaments 4, 5 are preheated by the input current to the intermittent oscillation circuit 30.

When the period of time necessary to sufficiently preheat the filaments 4, 5 has elapsed, the resistance of the thermistor 22, due to its negative temperature coefficient, is lowered and the a.c. current flows through the series circuit of the reverse charge capacitor 39, the thermistor 22, the positive bias coil 38, and the negative bias coil 37, whereby the inductor 8 is positively biased. Thus, the magnetic flux density amplitude of the inductor 8 increases and the oscillating voltage Vo of the intermittent high voltage oscillation circuit 30 also rises and is supplied to start the initial ignition of the discharge lamp 3, whereby the latter is lit. During the initial igniting period, if the reverse charge capacitor 39 is not provided, the oscillation circuit 31 immediately begins its oscillation, but by the action of the reverse charge capacitor 39, the balanced voltage between the terminal voltage of the oscillation capacitor 7 and the terminal voltage of the intermittent oscillation capacitor 11 sometimes does not reach the break-over voltage of the thyristor 9, whereby the oscillation of the intermittent high voltage oscillation circuit 30 may be interrupted. However, the resistance value of the thermistor 22 with its negative temperature coefficient prevents such interruption. Further, during the lighting of the discharge lamp an intermittent oscillation is sustained because the overlapped terminal voltage of the intermittent oscillation capacitor 11 and the lamp voltage of the discharge lamp 3 are supplied to the thyristor 9 which thus becomes conductive.

Since the high voltage generating intermittent oscillation circuit 30 starts oscillating in response to the overlapped power source voltage and the terminal voltage of the intermittent oscillation capacitor 11, the phase difference between the power source voltage and the input current becomes small. Further, becuse the overlapped voltage of the oscillating output voltage and the terminal voltage of the capacitor 11 are supplied to the discharge lamp 3, the power source voltage may be lowered, which has the advantage that the ballast choke 2 may be miniaturized. Further, because the discharge lamp 3 cannot be reignited by the voltage of the power source only, the intermittent oscillation circuit 30 generates a high voltage at each half cycle to reignite the discharge lamp 3 to thereby sustain the arc discharge and lit condition.

After the discharge lamp 3 has started the initial ignition, the reverse charging rate of the capacitor 39 varies according to the power source regulation because the intermittent oscillation capacitor 11 is reversely charged through the series circuit of the reverse charge capacitor 39, the thermistor 22 and positive bias coil 38. Thus, the size of the ballast choke may be still further reduced.

FIG. 11 is a circuit diagram of a discharge lamp lighting device also employing an "every half cycle ignited operating system" in a further embodiment of the present invention. In FIG. 11 a discharge lamp 3 is connected in series with an a.c. power source 1 through a ballast choke 2. An intermittent oscillation circuit 40 functions as a high frequency and high voltage oscillating means and constitutes a characteristic feature of this embodiment. The circuit 40 is connected in parallel with the terminals of the lamp filaments 4, 5 on the side opposite the a.c. source. The intermittent oscillation circuit 40 comprises an oscillation circuit 41 including a parallel connected circuit of a series circuit of a nonlinear inductor 8 and a thyristor 9, and a series circuit of a positive bias coil 48 magnetically coupled with the inductor 8 and an oscillation capacitor 7 and a parallel connected circuit including an intermittent oscillation capacitor 11 and a series circuit of a thermistor 23 having a positive temperature coefficient and a negative bias coil 47 magnetically coupled with the inductor 8 which is connected in series with the oscillation circuit 41.

The circuit of FIG. 11 operates as follows. When the power source is switched on, the thermistor 23 first provides a low resistancce and a.c. current flows through the power source 1, the ballast choke 2, the filament 4, the thermistor 23, the negative bias coil 47, the positive bias coil 48, the oscillation capacitor 7, the filament 5, back to the power source 1, whereby the current charges the oscillation capacitor 7 until the terminal voltage of the capacitor 7 exceeds the break-over voltage of the thyristor 9. Then the oscillation circuit 41 starts the high frequency oscillation. At this time, the oscillation circuit 41 generates a continuous oscillation output because the intermittent oscillation capacitor 11 is made ineffective by the positive temperature coefficient of the thermistor 23. Accordingly, the input current to the oscillation circuit 41 preheats the filaments 4, 5, and the dominant action of the negative bias coil 47, compared with that or the positive bias coil 48 acts to lower the magnetic flux density amplitude of the inductor 8. As a result, the output voltage of the oscillation circuit 41 is initially restricted to a value below that necessary for the starting voltage of the discharge lamp 3. During the period when the oscillation circuit 41 is prevented from generating its oscillating voltage under the necessary starting voltage of the discharge lamp 3, the oscillation circuit 41 generates a continuous oscillation, and a comparatively large current preheats the filaments 4, 5.

Meanwhile, as a certain time elapses after the supply power source has been switched on, the resistance of the thermistor 23 gradually increases due to the positive temperature coefficient and the resistance becomes a maximum when the filaments of the discharge lamp 3 assume the "hot cathode" state. After this time, the input current to the oscillation circuit 41 flows through the intermittent oscillation capacitor 11, the negative bias coil 47 becomes ineffective and only the positive bias coil 48 positively biases the inductor 8, thereby causing an increase of the inductance of the inductor 8. Accordingly, the high frequency oscillating voltage is raised above the necessary starting voltage of the discharge lamp 3. Under such condition, the discharge lamp 3 starts the initial ignition when the risen high frequency oscillating voltage is supplied to both ends of the discharge lamp 3. At this time, because the intermittent oscillation capacitor 11 is discharged by the power source voltage at the end portion of the oscillating action of the oscillation circuit 41, the latter stops oscillating. Then, even after the initial ignition of the discharge lamp 3 started, the intermittent high voltage oscillation circuit 40 generates the intermittent oscillation in the same manner at each given phase of each half cycle of the power source voltage and the discharge lamp 3 is reignited at each half cycle to maintain the lit condition.

Further, also even in this embodiment of FIG. 11, by an adequate selection of the magnetic flux density amplitude of the inductor 8, only the negative bias coil 47 may be provided.

A barium titanate capacitor, which has the characteristics that the electrostatic capacitance is largest at normal temperature and decreases as the temperature rises or falls, may be used for instance, as an oscillation capacitor 7, 7*a*, or 7*b*. Such a capacitor generates the higher oscillating voltage corresponding to the necessary starting voltage of the discharge lamp raised by the surrounding high or low temperature. Furthermore, when the environmental temperature is such that in spite of an oscillating voltage supply, a discharge lamp is unable to start the initial ignition for lack of electron emission in the discharge lamp, such a capacitor reduces the high frequency oscillating current when the capacitor is itself heated to abnormal high temperature. Accordingly, burning of the circuit components of an oscillation circuit may be prevented by such a capacitor. The oscillation capacitor may be thermally coupled with the thermistor 23 having a positive temperature coefficient or with the thermistor 22 having a negative temperature coefficient.

As described above, according to the present invention, a discharge lamp lighting device is disclosed which is able to prevent sputtering by means of a comparatively simple construction, thereby assuring a long operational life for the discharge lamp or lamps.

FIG. 12 shows a modification of the circuit of FIG. 11. In this circuit an intermittent oscillation capacitor 11 is unoperable at a starting time due to a positive temperature coefficient thermistor 23 connected across the capacitor 11. An intermittent oscillating circuit 50 is formed by an oscillation circuit 51 and the capacitor 11. The oscillation circuit 51 comprises an oscillation capacitor 7, a ballast choke 8, a thyristor 9 and a positive bias coil 58 magnetically coupled with the inductor 8. The thermistor 23 with a positive temperature coefficient, has a relatively small resistance at the beginning of the starting time period, but its resistance gradually increases. The bias coil 58 is used to increase the oscillating output $V_R$ by positively biasing the inductor 8. However, when the resistance of the thermistor becomes large, the intermittent oscillation capacitor 11 acts effectively to cause the normal operation in the "every half cycle ignited system".

Although the invention has been described with reference to specific example embodiments, it is to be understood, that it is intended to cover all modifications and equivalents within the scope of the appended claims.

What is claimed is:

1. A discharge lamp lighting device, comprising an a.c. power source, a current limiting means, discharge lamp means connected in series with said power source through said current limiting means, high voltage generating means operatively connected across said discharge lamp means, wherein said discharge lamp means comprise respective filament means, and wherein said high voltage generating means comprise an oscillation circuit (15) including a first series circuit of a nonlinear inductor (8) and a thyristor (9), and a second series circuit including an oscillation capacitor (7), a thermistor (12) having a negative temperature coefficient, and a biasing coil means (18), said second series circuit being connected in parallel to said first series circuit, and means operatively connecting said first oscillation circuit (15) to said filament means of said discharge lamp means for generating a high frequency high voltage, whereby said thermistor (12) operates for restricting the high voltage output at the beginning of operation for a given length of time, whereby the operational life of said discharge lamp means is improved.

2. The lighting device of claim 1, wherein said high voltage generating means includes a further capacitor (11) for providing an intermittent output oscillation, said further capacitor being connected in series with said parallel connected first and second series circuits, and wherein said intermittent output oscillation of said high voltage generating means is used for the reignition of said discharge lamp at each half cycle of said power source.

3. The lighting device of claim 1, wherein said high voltage generating means operates as an electronic starter and stops its operation when said discharge lamp is lit after initial ignition.

4. The lighting device of claim 1, wherein said negative temperature coefficient thermistor (12) is connected in said second series circuit for initially limiting the discharge lamp current substantially to zero.

5. The lighting device of claim 1, wherein said high voltage generating means comprise an intermittent oscillation circuit including an intermittently oscillating capacitor and a nonlinear inductor connected in series circuit with a thyristor, said capacitor being connected in series with said series circuit of said thyristor and said nonlinear inductor, and wherein the intermittent oscillating output of said intermittent oscillating circuit is utilized for the reignition of said discharge lamp means at each half cycle of said power source.

6. A discharge lamp lighting device, comprising an a.c. power source, current limiting means, discharge lamp means connected in series with said a.c. power source through said current limiting means, high voltage generating means operatively connected across said discharge lamp means, wherein said high voltage generating means comprise an oscillation circuit including a parallel connection of an oscillation capacitor and a series circuit of a nonlinear inductor (8) and a thyristor, wherein said discharge lamp means comprises a filament operatively connected to said high voltage generating means for preheating by the output of said high voltage generating means, and output control means comprising negative and positive bias circuit means operatively connected to said nonlinear inductor for changing the magnetic flux density amplitude of said nonlinear inductor in such a manner that said output of said high voltage generating means is restricted to be below the lamp starting voltage when the discharge lamp means is in the cold cathode state and above the lamp starting voltage when the discharge lamp means is in the hot cathode state.

7. The lighting device of claim 6, wherein said negative bias circuit means decrease the magnetic flux density amplitude of said nonlinear inductor in the cold cathode state of said discharge lamp means, and wherein said positive bias circuit means increase the magnetic flux density amplitude of said nonlinear inductor during the inoperative state of said negative bias circuit means so that the output voltage produced by said high voltage generating means is higher than the starting voltage of said discharge lamp and vice versa.

8. The lighting device of claim 6, wherein said negative bias circuit means include a negative biasing coil coupled to said nonlinear inductor and a positive temperature coefficient thermistor connected to said biasing coil.

9. The lighting device of claim 6, wherein said positive bias circuit means include a positive biasing coil coupled to said nonlinear inductor and a negative temperature coefficient thermistor connected to said biasing coil.

10. The lighting device of claim 6, wherein said negative and positive biasing circuits means include negative and positive biasing coils coupled to said nonlinear inductor and positive and negative temperature coefficient thermistors connected to the respective biasing coil.

11. A discharge lamp lighting device, comprising an a.c. power source, current limiting means, discharge lamp means connected in series with said power source through said current limiting means, high voltage generating means operatively connected across said discharge lamp means, output control means operatively connected to said high voltage generating means for restricting the high voltage output at the beginning of operation for a given length of time, wherein said discharge lamp means is a hot cathode type discharge lamp having a filament, and wherein said high voltage generating means includes a first oscillation capacitor (7), a series circuit of a thyristor (9) and a nonlinear inductor (8), a second intermittent oscillation capacitor (11) connected in series with said series circuit which in turn is connected in parallel with said first oscillation capacitor (7), and wherein said control means comprise means connected for deactivating said second intermittent oscillation capacitor at the starting time of said discharge lamp, said deactivating means including a positive temperature coefficient thermistor (23) connected in parallel to said intermittent oscillation capacitor whereby the operational life of said discharge lamp means is is improved.

* * * * *